US009064362B2

(12) United States Patent
Willis

(10) Patent No.: US 9,064,362 B2
(45) Date of Patent: Jun. 23, 2015

(54) DISK SORTING DEVICE

(71) Applicant: Asahi Seiko Co., Ltd., Tokyo (JP)

(72) Inventor: Marcus John Willis, Tunbridge Wells Kent (GB)

(73) Assignee: ASAHI SEIKO CO., LTD., Tokyo (JP)

( * ) Notice: Subject to any disclaimer, the term of this patent is extended or adjusted under 35 U.S.C. 154(b) by 0 days.

(21) Appl. No.: 14/147,951

(22) Filed: Jan. 6, 2014

(65) Prior Publication Data

US 2014/0199928 A1 Jul. 17, 2014

(30) Foreign Application Priority Data

Jan. 11, 2013 (GB) ..... 1300462.7

(51) Int. Cl.
*G07D 3/14* (2006.01)
*G07D 1/02* (2006.01)

(52) U.S. Cl.
CPC ..... *G07D 3/14* (2013.01); *G07D 2201/00* (2013.01); *G07D 1/02* (2013.01)

(58) Field of Classification Search
CPC ..... G07D 1/00; G07D 3/14; G07D 2201/00
USPC ..... 453/3, 4, 18, 29, 49, 57, 30, 32, 33, 34, 453/35; 194/334, 342, 344, 346
See application file for complete search history.

(56) References Cited

U.S. PATENT DOCUMENTS 3,680,566 A * 8/1972 Tanaka et al. ..... 453/4
3,916,922 A 11/1975 Prumm
5,145,046 A 9/1992 Satoh
5,496,212 A 3/1996 Meyer-Weingartner et al.
7,186,176 B2 * 3/2007 Umeda ..... 453/29
2010/0203817 A1 * 8/2010 Rigo ..... 453/3
2012/0145741 A1 6/2012 Enomoto

FOREIGN PATENT DOCUMENTS

EP 2463217 A2 6/2012
JP 3-282693 A * 12/1991 ..... G07D 1/00
JP 2001-216553 A 8/2001
WO WO 99/06969 2/1999
WO 2009/104034 A2 8/2009

OTHER PUBLICATIONS

U.S. Appl. No. 14/100,439 to Minoru Enomoto, which was filed on Dec. 9, 2013.
Search report from E.P.O., mail date is Apr. 24, 2014, 13199445.1-1953 (7 Pages).

* cited by examiner

*Primary Examiner* — Mark Beauchaine
(74) *Attorney, Agent, or Firm* — Greenblum & Bernstein, P.L.C.

(57) ABSTRACT

A disk sorting device includes a housing defining a disk transport path for conveying disks from a disk transferring device. A disk identifying device is located adjacent the disk transport path for identifying the type of disk passing along the transport path. A disk diverting mechanism in the disk transport path downstream of the disk identifying device is operable to divert disks in accordance with the type of the disk determined by the disk identifying device into a selected one of at least a return path in which a disk returns to the disk transferring device and a dispense path in which a disk is directed towards a dispense outlet. The disk transport path is oriented with a vertical component whereby disks pass along the path and the diverting mechanism under gravity.

17 Claims, 13 Drawing Sheets

DISK SORTING DEVICE

BACKGROUND OF THE INVENTION

Field of the Invention

The invention relates to disk sorting devices, particularly for sorting disks or tokens of value such as coins, and also to disk sorting assemblies and methods of handling disks.

In the following description, we will refer exclusively to the handling of coins but it should be appreciated that the invention is applicable to a wide variety of other types of disk such as medals, tokens or the like for game machines while sorting assemblies can be used in a wide variety of applications including money changers, vending machines, ticket vending machines, gaming machines, car park transaction machines, amusement machines, 'self-service' checkout machines, 'back office' coin sorting etc.

Coin dispensers typically dispense a single denomination of coin from a single coin specific store in response to a command signal. Individual hoppers can be used in conjunction to cover a wide range of denominations. The command signal might indicate a number of coins to dispense or a total value. In response to that request, the coins are fed from a storage hopper to a dispense outlet, typically via an escrow store which is first filled with coins of the required denomination and from which the coins are then released to the dispense outlet. If an error occurs, for example there are insufficient coins available, the escrow will be operated to dispense the coins to a dump store or back to the storage hopper.

There is an increasing need to improve the speed at which coins are dispensed and to allow more flexibility while providing a dispenser which is convenient to utilize and in accordance with local legal requirements. For example, in the United Kingdom, the Disability Discrimination Act (DDA) requires that coins are dispensed at a certain height range suitable for use by disabled people.

EP-A-2463217 describes a disk transferring device particularly suitable for coins which incorporates a vertical disk guide path to transfer disks from a storage hopper to an upper outlet opening. The advantage of this device is that it can be sold as a universal device to handle whichever type, in this case diameter, of disk or coin the buyer wishes to use it with. Furthermore, it operates at high speed, up to 5 coins per second, thus improving significantly upon prior art dispensers. However, it can only handle disks or coins of one type (diameter) at one time depending upon the single type of disk held within the supply hopper.

Other examples of coin sorting devices are described in WO-A-99/06969, U.S. Pat. No. 3,916,922, U.S. Pat. No. 5,145,046, and U.S. Pat. No. 5,496,212.

There is a continuing need to improve coin and disk dispensers so as to make them even more efficient.

In accordance with the first aspect of the present invention, we provide a disk sorting device comprising a housing defining a disk transport path for conveying disks from a source; a disk identifying device located adjacent the disk transport path for identifying the type of disk passing along the transport path; and a disk diverting mechanism in the disk transport path downstream of the disk identifying device and operable to divert disks in accordance with the type of the disk determined by the disk identifying device into a selected one of at least a return path in which a disk returns to the source and a dispense path in which a disk is directed towards a dispense outlet, wherein the disk transport path is oriented with a vertical component whereby disks pass along the path and the diverting mechanism under gravity, wherein the disk diverting mechanism includes a single disk diverting surface movable orthogonally with respect to the disk transport path between a first position in which a disk passes to the return path, and a second position in which a disk passes to the dispense path, wherein in one of the first and second positions the surface is retracted away from the disk transport path so that a disk can fall undeflected past the disk diverting surface and in the other of the first and second positions the surface is inserted into the disk transport path.

We have realized that the fact that a disk transferring device exists (such as described in EP-A-2463217) which can handle disks of different types, such as diameters, means not only that the device can be used with a store holding disks of the same diameter (but in which the store could be replaced with another having disks of a different diameter) but it can also be used to dispense in sequence a mixture of disks of different diameters. This allows a variety of different combinations of disks to be dispensed. However, the problem with this approach is that there is no control over which disks enter the disk reception opening and in which order. We have therefore devised a disk sorting device which can be controlled in a very simple manner to sort between the disks output from the disk transferring device so as to generate a required combination of disks at the selected one of the outlets.

One of the advantages of the disk transferring device described in EP-A-2463217 is the speed at which it can operate, as mentioned above. However, in order to operate efficiently, the disk sorting device must also be able to operate at a similar or greater speed. Conventional diverting devices using flaps and the like suffer from problems of inertia thus providing limitations on the speed of operation.

We therefore provide a novel disk diverting mechanism as described above. The diverting mechanism is very simple and just requires movement of the diverting surface orthogonally to the disk transfer path and avoids any need for a rotational or other movement subject to relatively high inertial forces. In this way, the speed of operation of the disk diverting mechanism can be matched to the rate at which disks are supplied to the disk sorting device.

In some cases, the disk diverting mechanism could be operable to place the single disk diverting surface into the disk transport path to divert disks to the return path, however preferably, when the disk diverting surface is in the first position, the surface is retracted away from the disk transport path, and when the disk diverting surface is in the second position, the surface is inserted into the disk transport path. This maximizes the speed of the return operation.

Preferably, the disk diverting surface is biased towards the retracted position so that the default configuration results in disks passing into the return path and not being inadvertently dispensed.

This approach should be contrasted with that described, for example, in WO 99/06969 in which normally coins pass to a dispense outlet and a diverter has to be switched to a different mode to cause coins to pass to the return path.

The position of the diverting surface can be controlled by means of a solenoid or pneumatic/hydraulic control although other electric/electronic motor controllers could be used such as a stepper motor.

The disk identifying device can take a variety of forms which are known conventionally and can determine different types of disk including one or more of the size, for example diameter, thickness, weight, metal content and surface appearance of the disks. Thus, the disk identifying device could be electrical and identify the different disks by the individual "electronic fingerprint" associated with a particular denomination, providing the disks disrupt an electrical field. However, if the disks have no metallic content, for example some types of gaming tokens or "chips" are 100% plastic, then the identification could be performed physically or mechanically using a roller or pairs of rollers to check diameter/thickness.

SUMMARY OF THE INVENTION

As mentioned above, the disk sorting device according to the first aspect of the invention finds particular use in a disk sorting assembly comprising a disk transferring device for transferring disks of more than one type, delivered one by one, from a disk reception opening toward a disk ejection opening, the disk transferring device including:

a disk guide path having first and second guide surfaces that guide a peripheral surface of each of the disks and third and fourth guide surfaces that guide a front surface and a back surface of a disk, the disk guide path extending from the disk reception opening toward the disk ejection opening, and a plurality of disk pushers protruding into the disk guide path and pushing the disks by making a rotational movement about a plurality of rotational axis lines approximately at a right angle with respect to the third and fourth guide surfaces, the disk sorting device being mounted to the disk transferring device so as to receive disks from the disk ejection opening, and a plurality of disk pushers protruding into the disk guide path and pushing the disks by making a rotational movement about a plurality of rotational axis lines approximately at a right angle with respect to the third and fourth guide surfaces, characterized in that:

the assembly further comprises a disk sorting device according to the first aspect of the invention mounted to the disk transferring device so as to receive disks from the disk ejection opening.

In the most preferred example, the disk sorting device is detachable as a unit from the disk transferring device. This means that the disk sorting device can be fitted to a pre-existing disk transferring device, for example as an upgrade feature, very easily. Of course, in other cases, the disk sorting and transferring devices could be made as a more integrated unit, for example sharing the same housing.

Preferably, the disk transport path of the disk sorting device is arranged to maintain substantially the same orientation of the disks as they have in the disk guide path. This helps to avoid any problems as disks transfer from the transferring device to the sorting device. Typically, the disk transport path and the disk guide path are arranged to maintain the faces of the disks vertically oriented. This orientation reduces the footprint of the device.

In some cases, disks are conveyed along the disk transport path of the disk sorting device by a positive feeder such as a belt or rollers but in the preferred example, the disk guide path and the disk transport path both extend generally vertically, whereby disks pass along the disk transport path under gravity. This avoids the need for any additional control mechanisms.

BRIEF DESCRIPTION OF THE DRAWINGS

An example of a disk sorting assembly and disk sorting device according to the invention will now be described with reference to the accompanying drawings, in which.

DETAILED DESCRIPTION OF THE PREFERRED EMBODIMENTS

Figure 1:
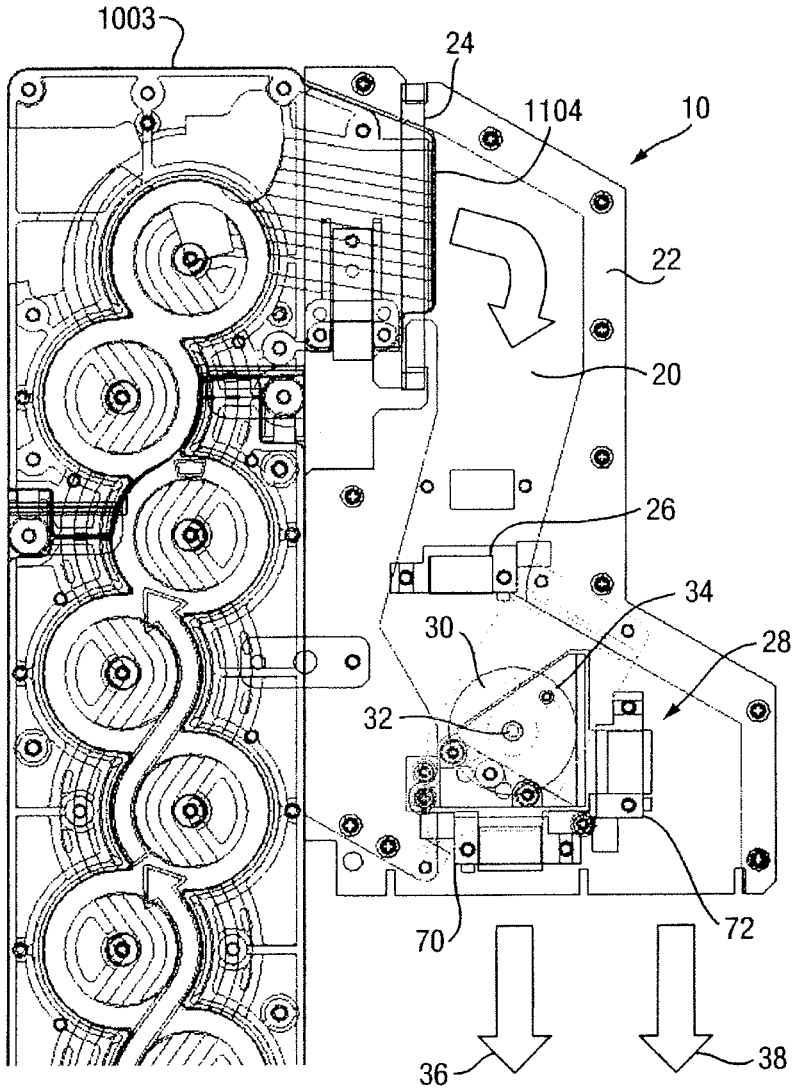
FIG. 1 is a schematic side elevation of the disk sorting assembly (with some parts omitted for clarity)

The disk sorting assembly shown in the drawings is designed to feed and sort coins of a variety of denominations and hence diameter and includes a disk transferring device 1003 having a disk reception opening 1102 and disk ejection opening 1104 (FIG. 3), and a disk sorting device 10 detachably mounted to the disk transferring device 1003 into which disks are fed through the disk ejection opening 1104.

The construction of the disk transferring device 1003 is described in much more detail in EP-A-2463217 and so will only be described relatively briefly in this specification.

Figure 2:
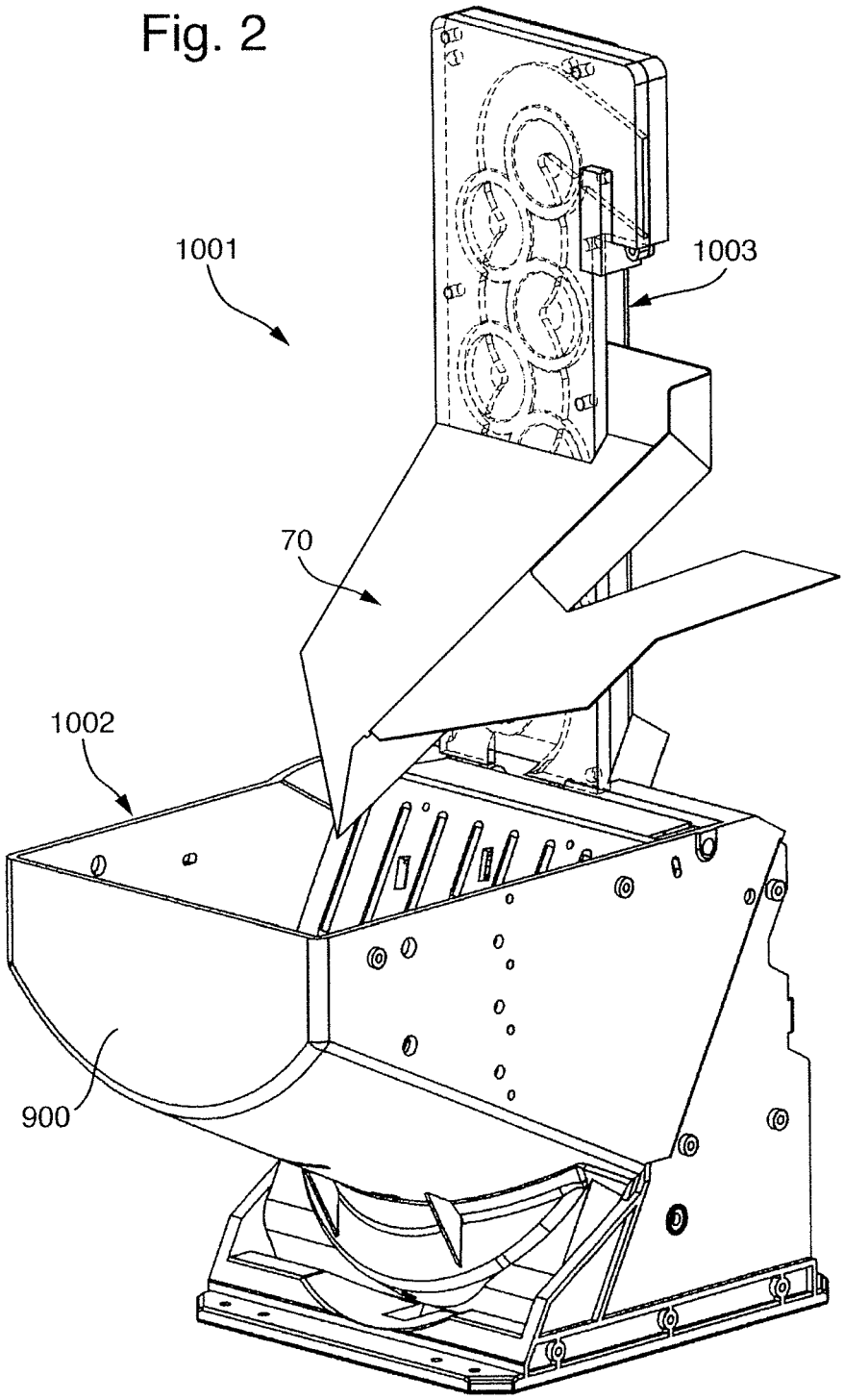
FIG. 2 is a perspective view of the disk sorting assembly shown in FIG. 1 but omitting the disk sorting device.

As can be seen in FIG. 2, the disk transferring device 1003 comprises a disk delivering device 1002 including a hopper 900.

For example, the disk delivering device disclosed in Japanese Unexamined Patent Application Publication No. 2001-216553 can be used.

Figure 3:
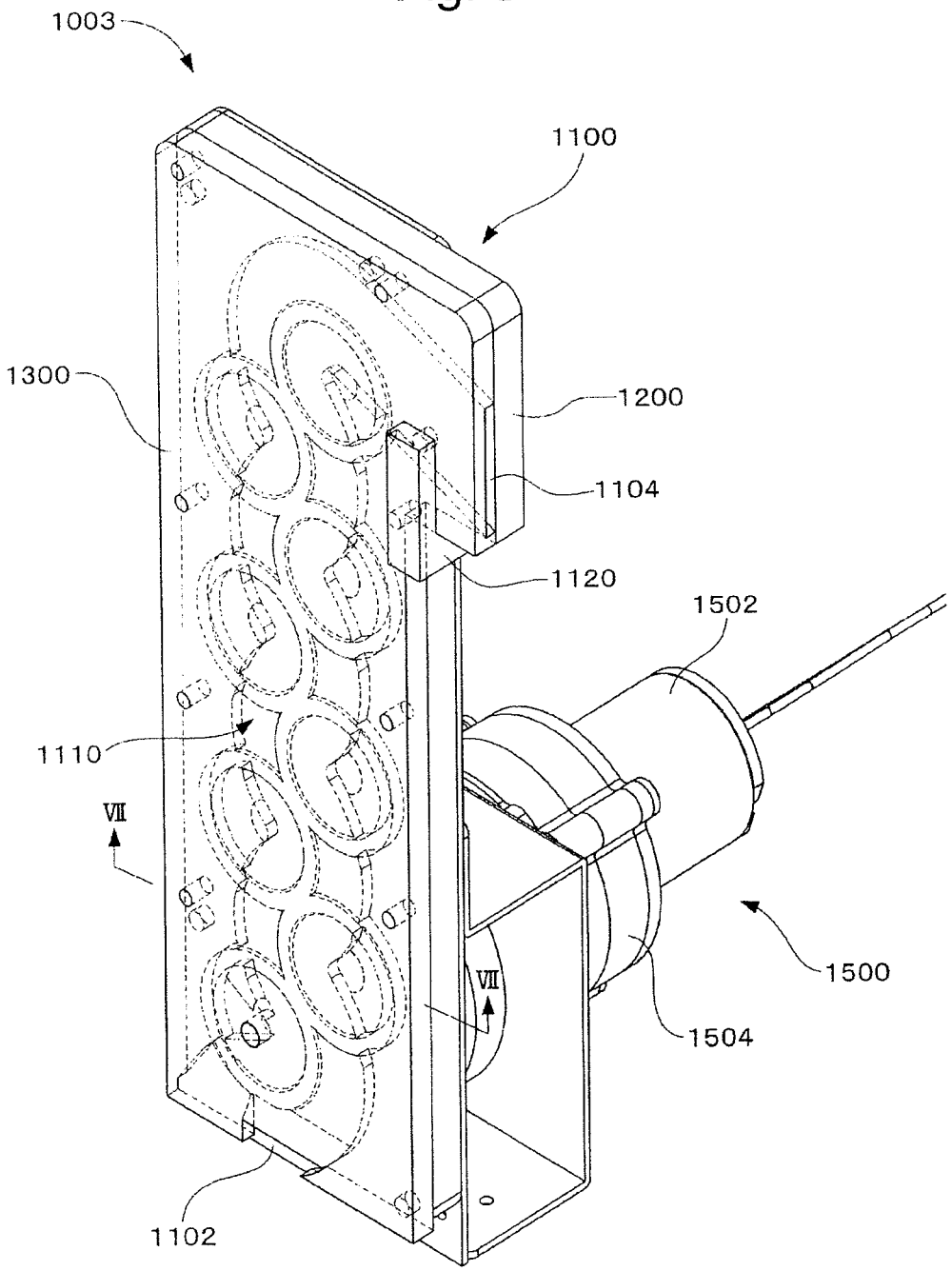
FIG. 3 is a perspective view of the main parts of the disk transferring device shown in FIGS. 1 and 2.
Figure 4:
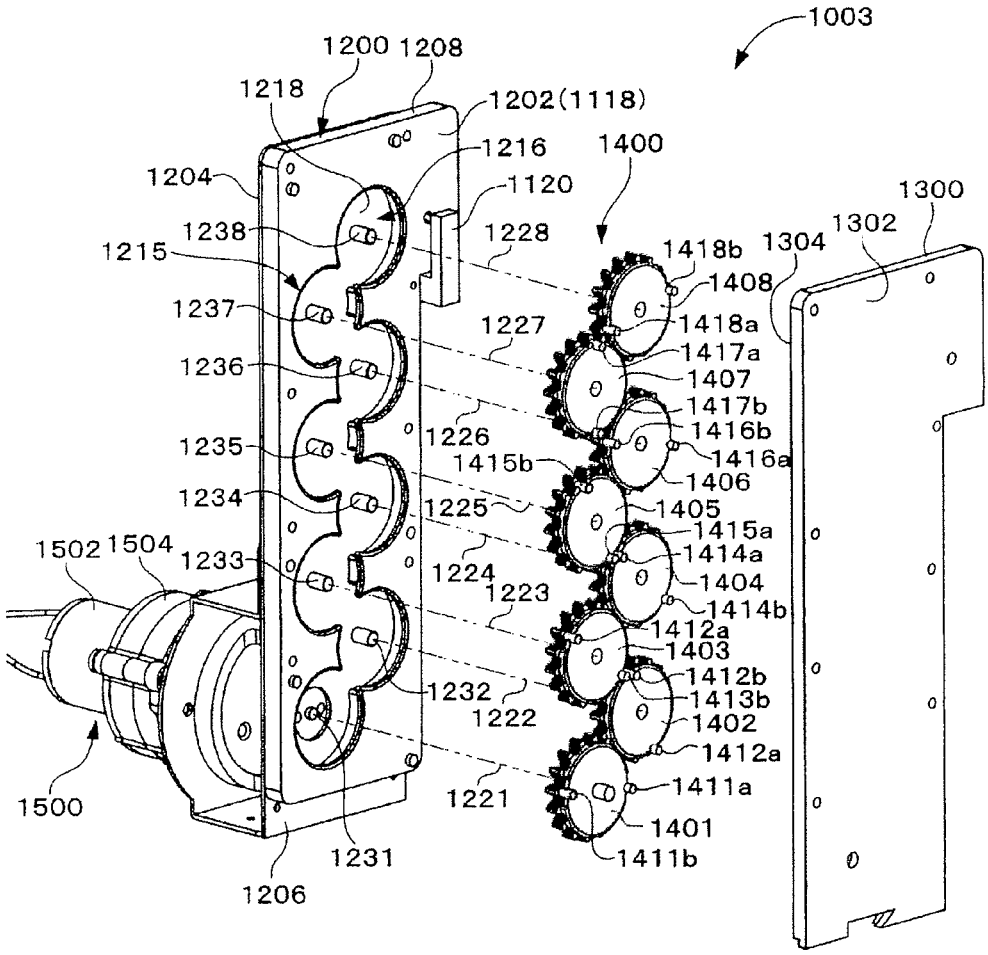
FIG. 4 is an exploded perspective view of the main parts of the disk transferring device of FIG. 3 viewed from a front side.

As shown in FIGS. 3 and 4, the disk transferring device 1003 includes a disk guide part 1100 having a disk guide path 1110 extending from the disk reception opening 1102 toward the disk ejection opening 1104, a disk pushing mechanism 1400 having first to eighth rotary disks 1401 to 1408 provided with first disk pushers 1411*a* to 1418*a* and second disk pushers 1411*b* to 1418*b*, respectively, and a rotational driving device 1500 for rotationally driving the disk pushing mechanism 1400.

As shown in FIGS. 3 and 4, the disk guide part 1100 is configured of a base part 1200 and a top plate 1300 provided on the base part 1200.

The base part 1200 is formed of a structure in which a flat-shaped first member 1206 has a second member 1208 placed thereon, and a through hole 1215 is formed in the second member 1208. The through hole 1215 has a flat shape with eight circular apertures connected in a zigzag manner, and has a recessed part 1216 that can accommodate the disk pushing mechanism 1400 on a front surface 1202 side of the base part 1200.

On a bottom surface 1218 of the recessed part 1216, first to eighth rotating shafts 1231 to 1238 are provided having first to eighth rotational axis lines 1221 to 1228 approximately at a right angle with respect to the front surface of the base part 1200. The first to eighth rotating shafts 1231 to 1238 are fixed to fixing screws inserted in screw holes from the back surface 1204 side of the base part 1200 via the first member 1206.

Figure 5:
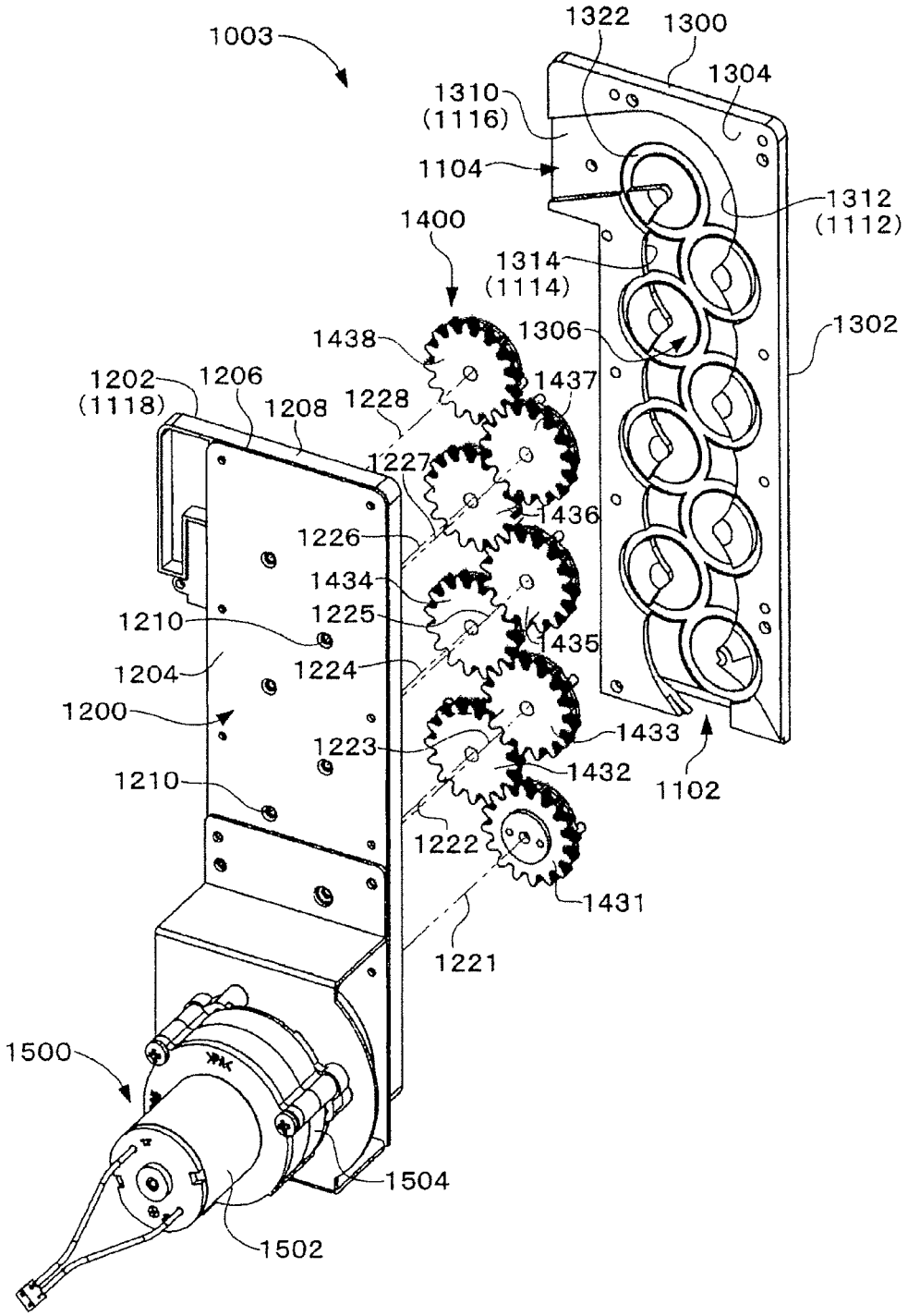
FIG. 5 is an exploded perspective view of the main parts of the disk transferring device of FIG. 3 viewed from a back side.

As shown in FIGS. 4 and 5, the top plate 1300 has a front surface 1302 and a back surface 1304 parallel to each other, and is fixed to the base part 1200 with the back surface 1304 being placed on the front surface 1202 of the base part 1200. The front surface 1302 and the back surface 1304 of the top plate 1300 is approximately at a right angle with respect to the first to eighth rotational axis lines 1221 to 1228.

On the back surface 1304 side of the top plate 1300, a disk guide groove 1306 extending from the disk reception opening 1102 to the disk ejection opening 1104 is formed. The disk guide groove 1306 has a bottom surface 1310 and first and second side surfaces 1312 and 1314, and the bottom surface 1310 is approximately at a right angle with respect to the first to eighth rotational axis lines 1221 to 1228.

The disk guide groove 1306 has a width wg and a depth dg that are set so as to be slightly larger than the width and depth of a disk to be transferred. In other words, the width wg and the depth dg of the disk guide groove 1306 are set so that the disk to be transferred can pass through the inside the disk guide groove 1306 as being guided with the bottom surface 1310 and the first and second side surfaces 1312 and 1314. Note that when a plurality of denominations of disks with different diameters and thickness are transferred, the width wg and the depth dg of the disk guide groove 1306 are set according to a maximum diameter and a maximum thickness of the disks.

The first side surface 1312 is formed along a curve 1318 with a plurality of segments of circles centering on the second, fourth, sixth, and eighth rotational axis lines 1222, 1224, 1226, and 1228 connected together. The second side surface 1314 is formed along a curve 1316 with a plurality of segments of circles centering on the first, third, fifth, and seventh rotational axis lines 1221, 1223, 1225, and 1227 connected together.

Furthermore, on the back surface 1304 of the top plate 1300, an annular groove 1322 preventing a contact of first disk pushers 1411*a* to 1418*a* and second disk pushers 1411*b* to 1418*b*, which will be described further below, with the top plate 1300 when these disk pushers make a rotational movement is provided, correspondingly to the respective first to eighth rotational axis lines 1221 to 1228.

The disk guide path 1110 is configured of the front surface 1202 of the base part 1200, the bottom surface 1310 of the disk guide groove 1306 of the top plate 1300, and the first and second side surfaces 1312 and 1314. In other words, the front surface 1202 of the base unit 1200 functions as a back guide surface 1118 of the disk guide path 1110, the bottom surface 1310 of the disk guide groove 1306 of the top plate 1300 functions as a front guide surface 1116 of the disk guide path 1110, and the first and second side surfaces 1312 and 1314 of the disk guide groove 1306 of the top plate 1300 function as left and right guide surfaces 1112 and 1114 of the disk guide path 1110. In the disk guide path 1110, the peripheral surface of a disk introduced from the disk reception opening 1102 is guided with the left and right guide surfaces 1112 and 1114 of the disk guide path 1110 (that is, the first and second side surfaces 1312 and 1314 of the disk guide groove 1306). Also, on an front surface and a back surface of a disk are guided with the front and back guide surfaces 1116 and 1118 of the disk guide path 1110 (that is, the bottom surface 1310 of the disk guide groove 1306 and the front surface 1202 of the base part 1200).

As shown in FIGS. 4 and 5, the disk pushing mechanism 1400 has the first to eighth rotary disks 1401 to 1408 having the first to eighth rotating shafts 1231 to 1238, respectively, inserted therein. The first to eighth rotary disks 1401 to 1408 each have an approximately circular outer shape in a planar view, and are each rotatably supported in the corresponding first to eighth rotating shafts 1231 to 1238 in both forward and reverse directions. In other words, the first to eighth rotary disks 1401 to 1408 can rotate about the corresponding first to eighth rotational axis lines 1221 to 1228, respectively.

The first to eighth rotary disks 1401 to 1408 are provided with the first disk pushers 1411*a* to 1418*a* and the second disk pushers 1411*b* to 1418*b*, respectively, as a pair, each disk pusher having a columnar outer shape. That is, in a peripheral part 1424 of the first rotary disk 1401, the first and second disk pushers 1411*a* and 1411*b* protruding from the front surface 1422 of the rotary disk 1401 are provided. The first and second disk pushers 1411*a* and 1411*b* are arranged so as to interpose the first rotating shaft 1231. In other words, the first and second disk pushers 1411*a* and 1411*b* are arranged on a straight line passing through the first rotational axis line 1221 on the first rotary disk 1401.

Also for the second to eighth rotary disks 1402 to 1408, as with the first rotary disk 1401, in the peripheral parts 1424 of the second to eighth rotary disks 1402 to 1408, the first and second disk pushers 1412*a* and 1418*a* and 1412*a* to 1418*b* protruding from the front surfaces 1422 of the second to eighth rotary disks 1402 to 1408, respectively, are provided. The first and second disk pushers 1412*a* to 1418*a* and 1412*b* to 1418*b* are arranged so as to interpose the rotating shafts 1232 to 1238, respectively. In other words, the first and second disk pushers 1412*a* to 1418*a* and 1412*b* to 1418*b* are arranged on straight lines passing through the second to eighth rotational axis lines 1222 to 1228 on the second to eighth rotary disks 1402 to 1408, respectively.

When the first to eighth rotary disks 1401 to 1408 are rotated, the first and second pushers 1411*a* to 1418*a* and 1411*b* to 1418*b* make a rotational movement about the first to eighth rotational axis lines 1221 to 1228, respectively.

The rotational driving device 1500 has an electric motor 1502 and a decelerating mechanism 1504 having connected thereto a driving shaft (not shown) of the electric motor 1502. An output shaft (not shown) of the decelerating mechanism 1504 is connected to the first rotating shaft 1231. The first rotary disk 1401 and the first gear wheel 1431 are connected to the output shaft of the decelerating mechanism 1504 via the first rotating shaft 1231.

For the first gear wheel 1431 to be caused to function as a driving gear wheel, the first rotary disk 1401 and the first gear wheel 1431 are fixed to the first rotating shaft 1231. Therefore, when the electric motor 1502 is activated, the rotation of the driving shaft of the electric motor 152 is transmitted via the decelerating mechanism 1504 to the first rotating shaft 1231, thereby rotating the first rotary disk 1401 and the first gear wheel 1431. Since adjacent ones of the first to eighth gear wheels 1431 to 1438 engage with each other, the rotation of the first gear wheel 1431 is transmitted to the second to eighth gear wheels 1432 to 1438 sequentially. That is, the second to eighth gear wheels 1432 to 1438 function as driven gear wheels. As such, the disk pushing mechanism 1400 is driven, thereby causing the first to eighth rotary disks 1401 to 1408 to rotate and causing the first and second disk pushers 1411*a* to 1418*a* and 1411*b* to 1418*b* to make a rotational movement.

As explained in more detail in EP-A-2463217, rotation of the disks 1401-1408 causes disks or coins to be fed from a hopper 900 up through the disk transferring device to the disk ejection opening 1104.

As can be seen in FIG. 1, the disk ejection opening 1104 opens into a disk transport path 20 formed within a housing 22 of the disk sorting device 10. The disk sorting device is detachably secured to the housing of the disk transferring device 1003 by brackets 40 (FIG. 6) and bolts (not shown).

At the entrance to the disk transport path 20 is provided a coin sensing coil 24 which is wound around the housing 22 and through which each coin or disk will pass as it enters the disk transport path 20. This coil forms the inductive element of a Colpitts oscillator circuit (not shown). As a coin passes through the coil, the inductance increases and this increase causes a change in the oscillator's frequency and amplitude. The amount and type of change allows the coin to be identified by a control PCB (not shown) in a conventional manner.

In a modification (not shown) a second coin sensing coil similar to the coil 24 is provided in a substantially horizontal orientation around a vertically extending part of the transport path 20 upstream of a coin entry sensor 26 (to be described). This helps to improve the coin identification performance.

The coin then falls under gravity through the disk transport path 20 and passes the coin entry sensor 26 located upstream of a disk diverting mechanism 28.

The disk diverting mechanism 28 comprises a solenoid 30 having an axially movable actuator 32. The solenoid is typically a push/pull, 24V DC solenoid, type 341C manufactured by Densitron/Geeplus and can move the actuator 32 between its two positions in about 22 milliseconds. This is much faster than the shortest time between successive coins fed by the disk transferring device (⅕ seconds or 200 milliseconds).

The disk diverting mechanism further includes a diverter member or gate 34 non-rotatably attached to the actuator 32 so that it can be moved orthogonally with respect to the disk transport path 20 between a first position in which coins can pass undiverted to a first, return outlet 36, and a second position in which it diverts coins to a second dispenser coin outlet 38.

As mentioned above, as alternatives to the solenoid 30, it is possible to use a pneumatically controlled actuator, a stepper motor or the like.

The advantage of diverters according to the invention over conventional flap operated diverters is that there is less inertia involved as compared with a flap based diverter and thus they can be operated more quickly and efficiently and thus match the feed speed of the disk transferring device 1103.

As can be seen in FIG. 2, the coin outlet 36 cooperates with a guide plate 70 so that coins ejected through the outlet 36 will slide down the guide plate 70 back into the hopper 900. On the other hand, coins passing out of the dispense outlet 38 will pass to a dispense position (not shown) where they can be retrieved by an operator.

The actuator 32 is biased by a compression spring or the like (not shown) towards its first position so that as a default, coins will fall towards the coin outlet 36 for return to the hopper 900 and this avoids inadvertent dispense.

Figure 6:
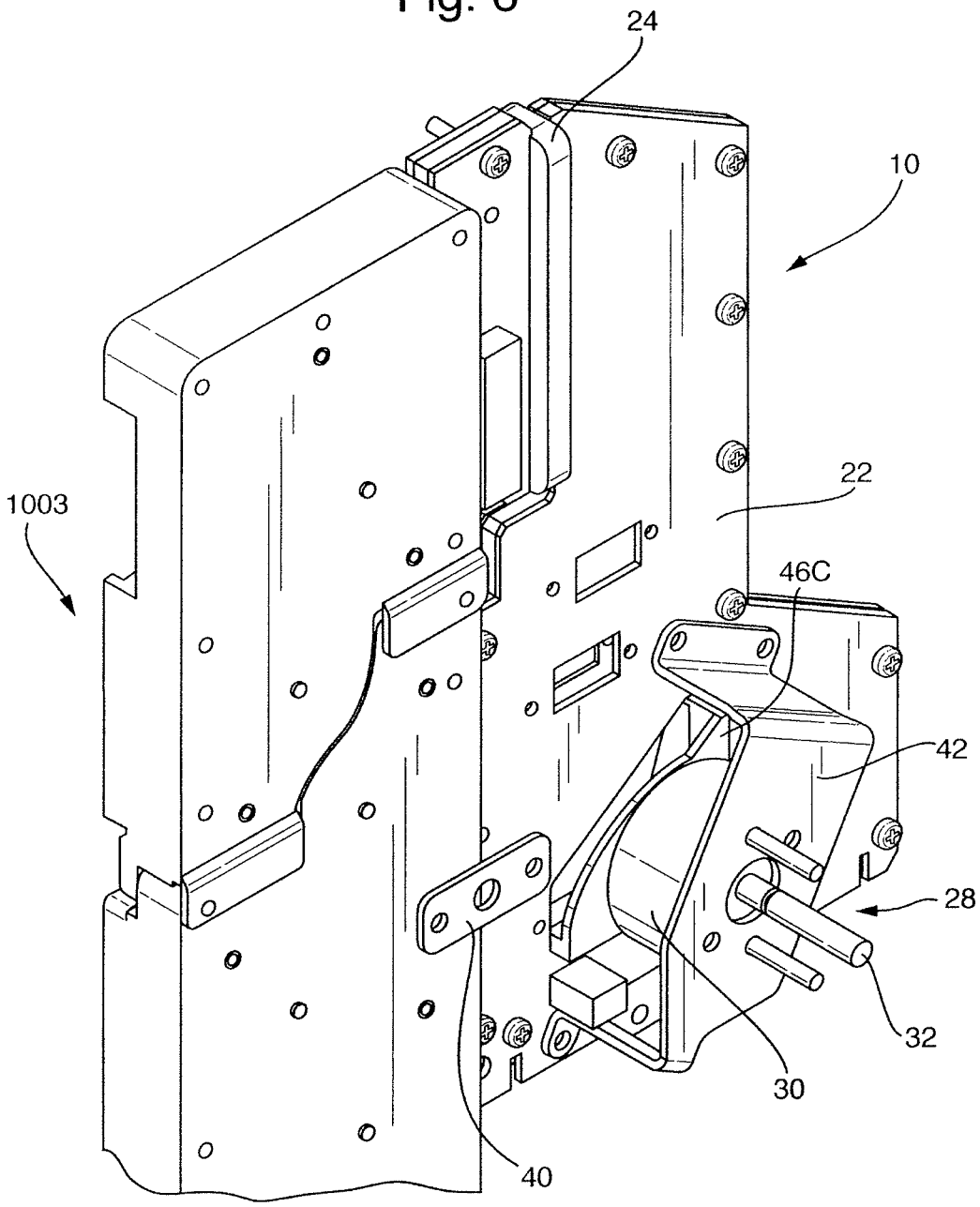
FIG. 6 is a perspective view of the rear of the upper part of the assembly shown in FIG. 1.

FIG. 6 illustrates an upper part of the disk sorting device 10 and in particular the way in which the disk diverting mechanism 28 is mounted. Thus, this mechanism 28 includes a mounting bracket 42 to which is attached the solenoid 30. The bracket 42 is secured to the housing 22 as shown. The actuator 32 has the diverter member 34 attached to its end which is thus supported by the solenoid 30 for movement to and fro orthogonal to the housing 22 and bracket 42.

Figure 7:
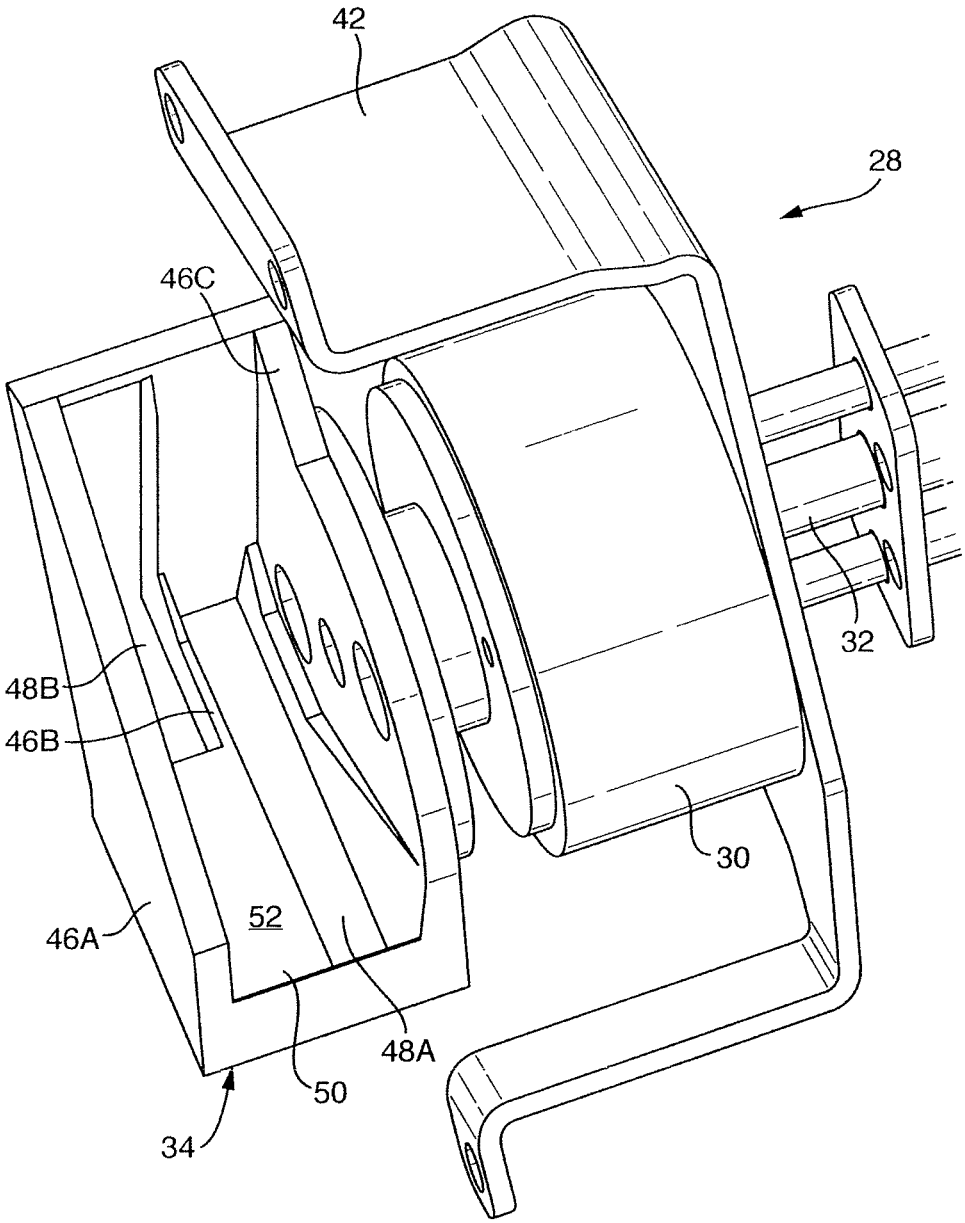
FIG. 7 is an enlarged, perspective view of the disk diverting mechanism shown in FIG. 6.

As can be seen in FIG. 7, the diverting member 34 is formed by two side plates 46A and 46C secured together in a spaced apart configuration with a dividing bar 46B between them to define a pair of guide slots 48A and 48B respectively. The guide slot 48A is fully open at its lower end along the length of the member 34 while the guide slot 48B has a web 50 located along part of its base to define a coin diverting surface 52.

FIG. 8A-8E are similar to FIG. 6 but with the housing plate facing the viewer removed and hence the solenoid 30 is not visible.

Figure 8A:
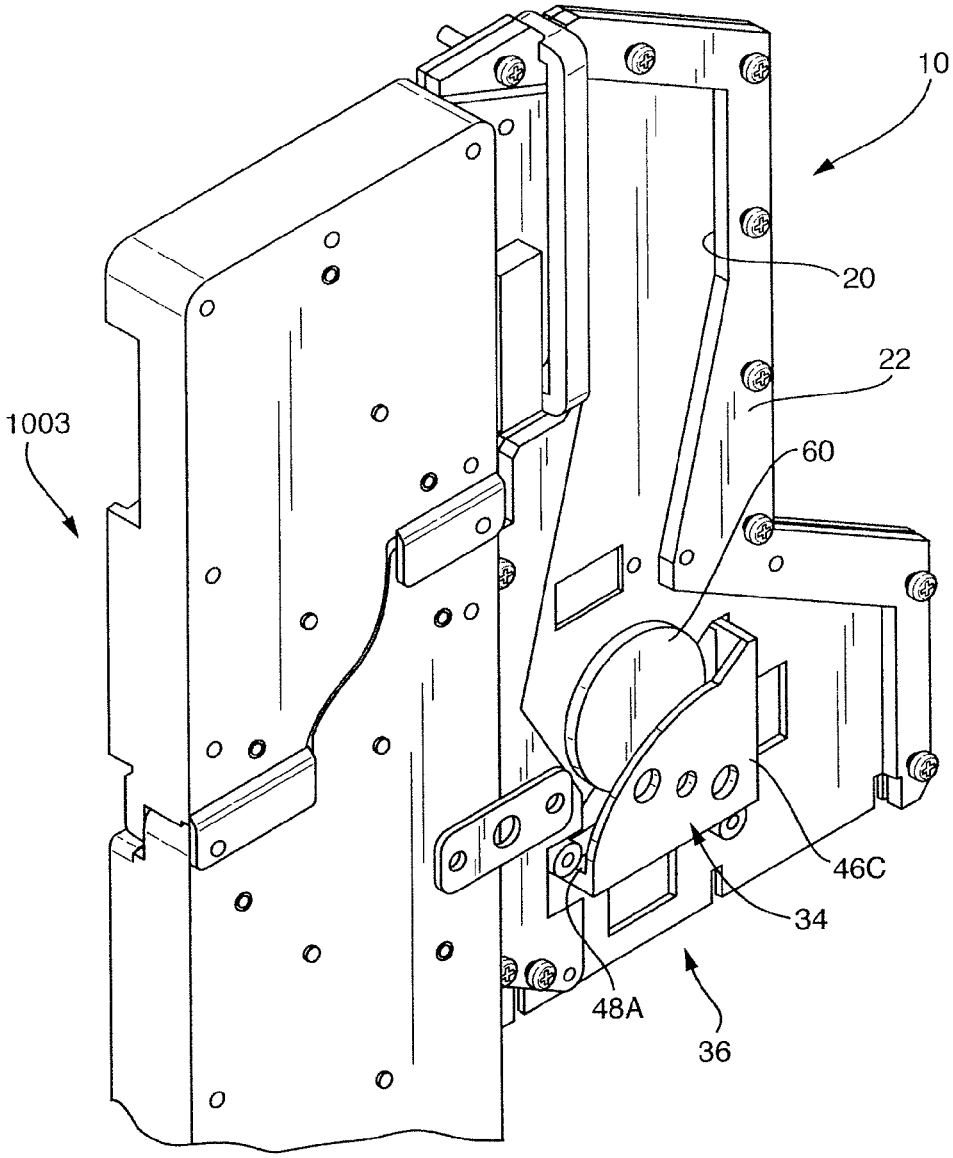
FIGS. 8A-8E are views similar to FIG. 6 but with part of the disk sorting device housing removed and part of the disk diverting mechanism shown as transparent and illustrating operation of the disk sorting device; and, FIG. 9 is a schematic, block diagram illustrating the control components of the assembly.
Figure 8B:
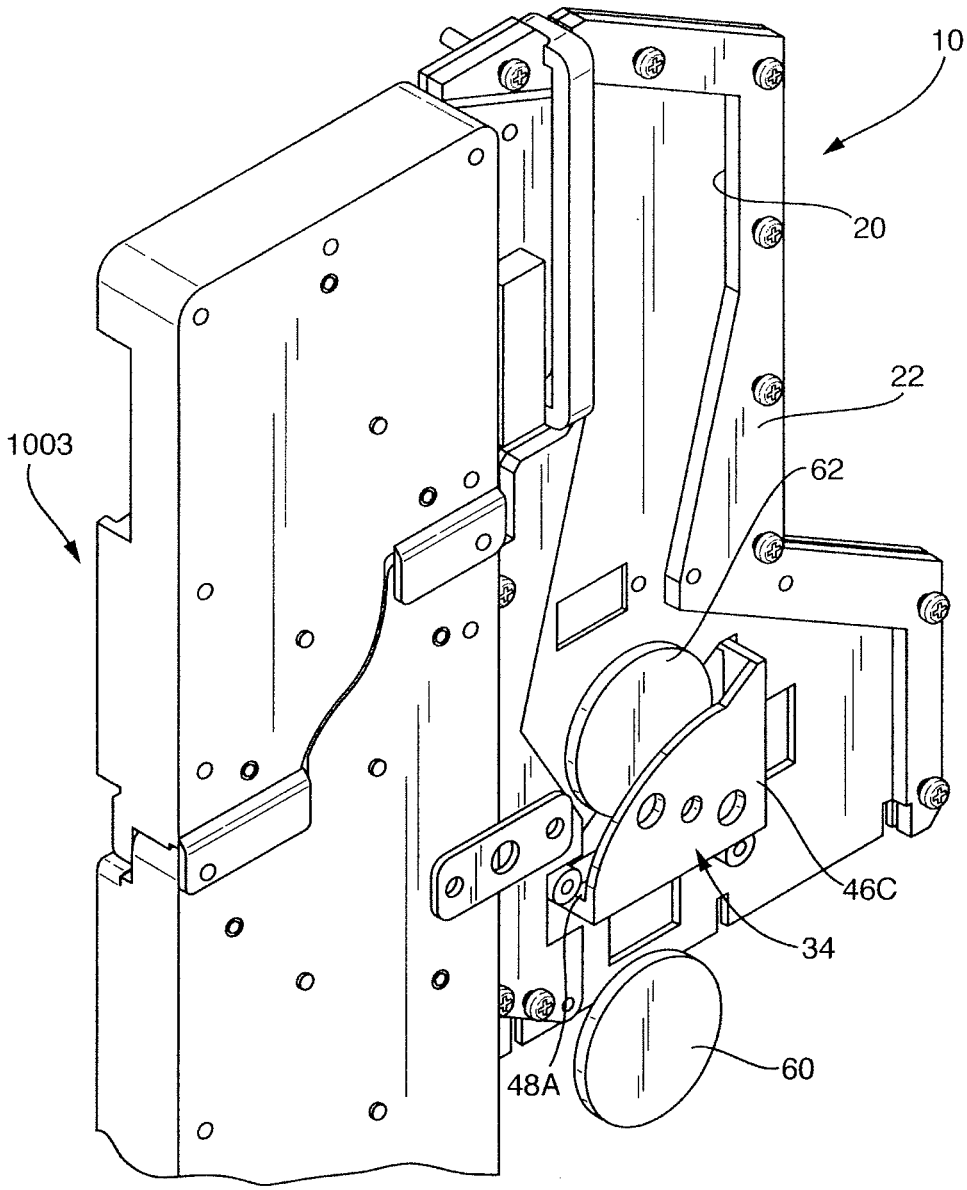

In FIG. 8A, the actuator 32 is in its rest or first position, spring biased to bring the slot 48A into alignment with the disk transport path 20. In this position, a coin 60 arriving at the diverting member 34 passes through the slot 48A undiverted towards the outlet 36 and hence back to the hopper 900 via the guide plate 70. This process can be seen further in FIG. 8B which also shows the arrival of a second coin 62 which also is to pass to the hopper 900.

Figure 8C:
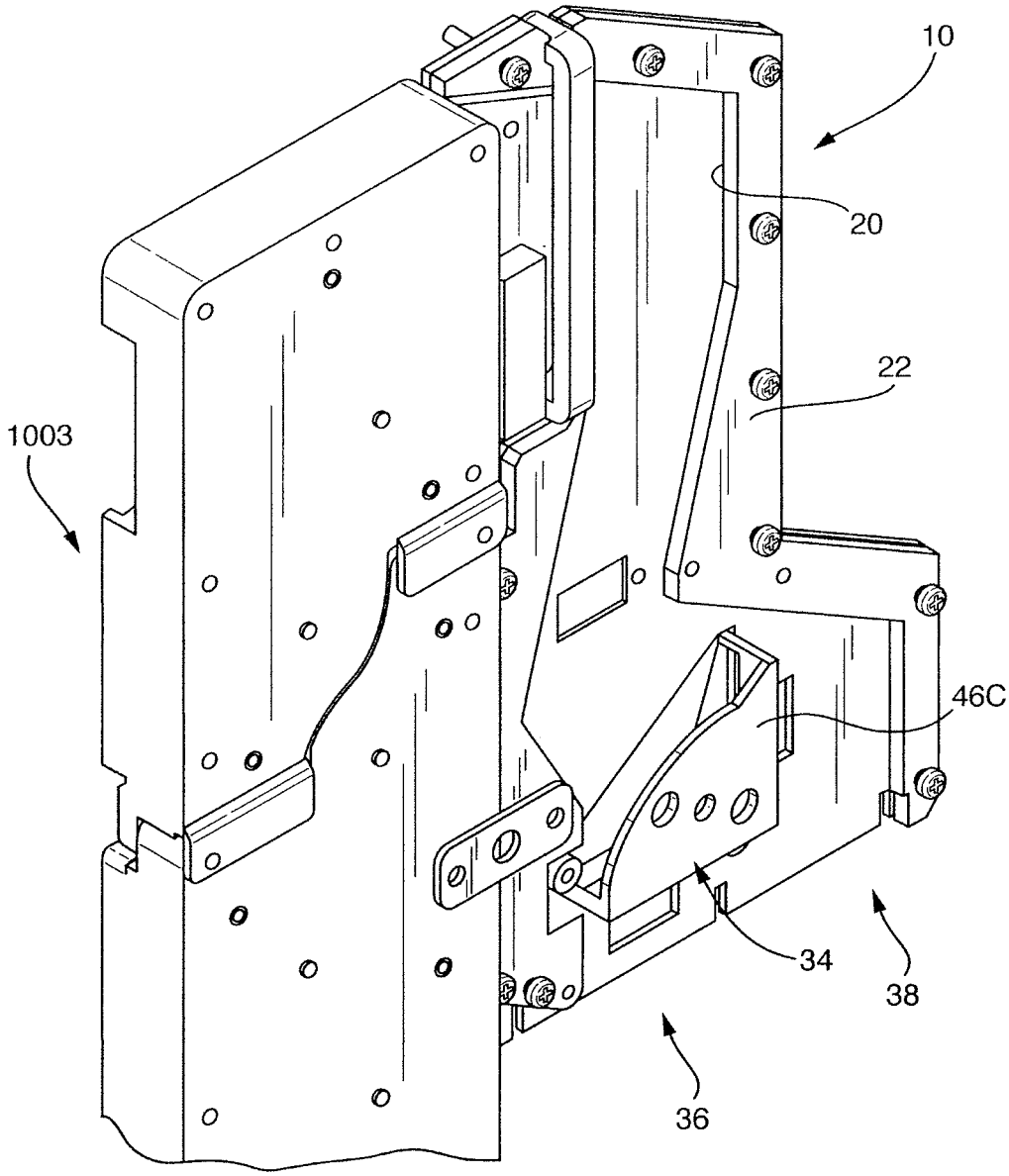
Figure 8D:
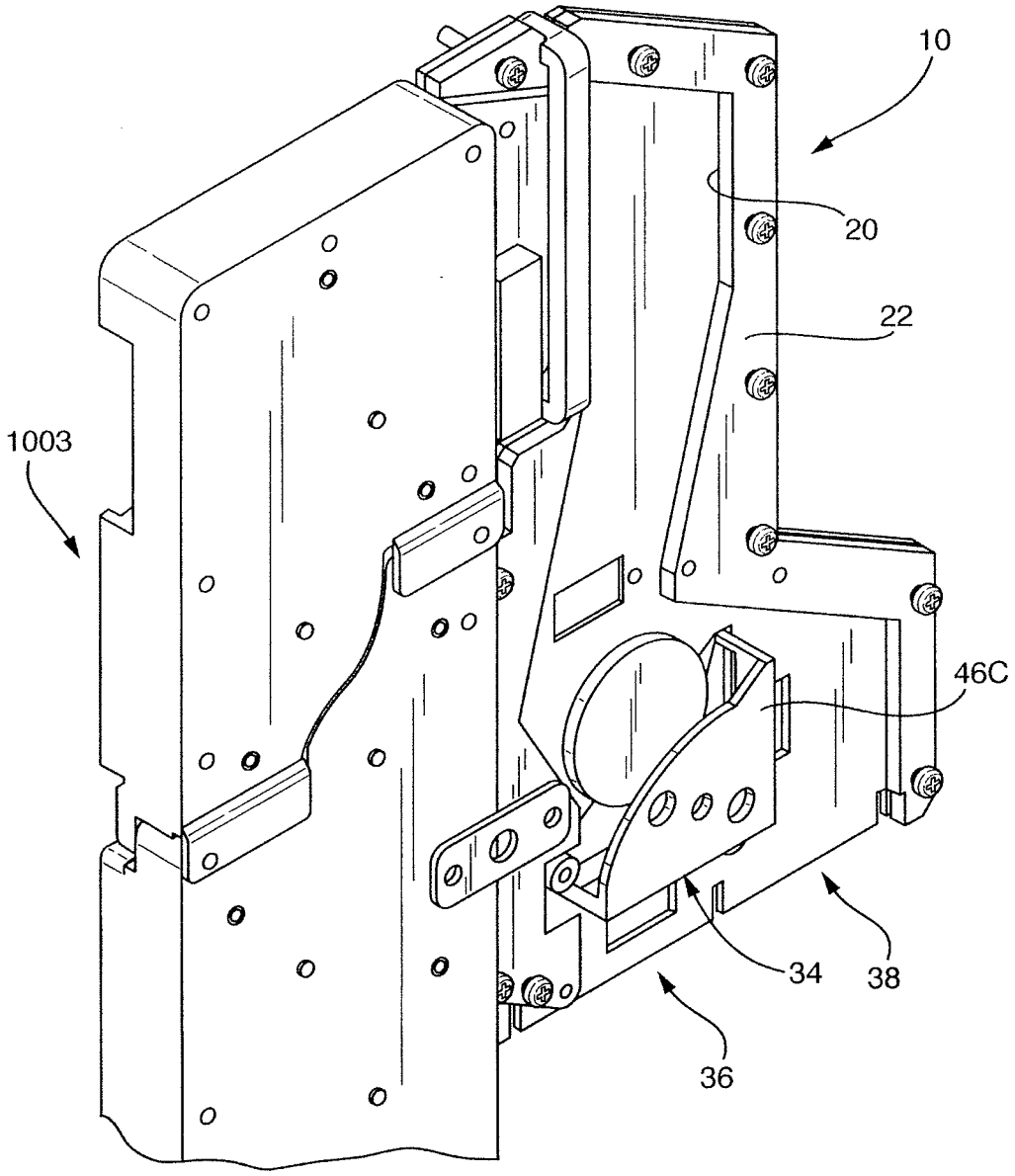
Figure 8E:
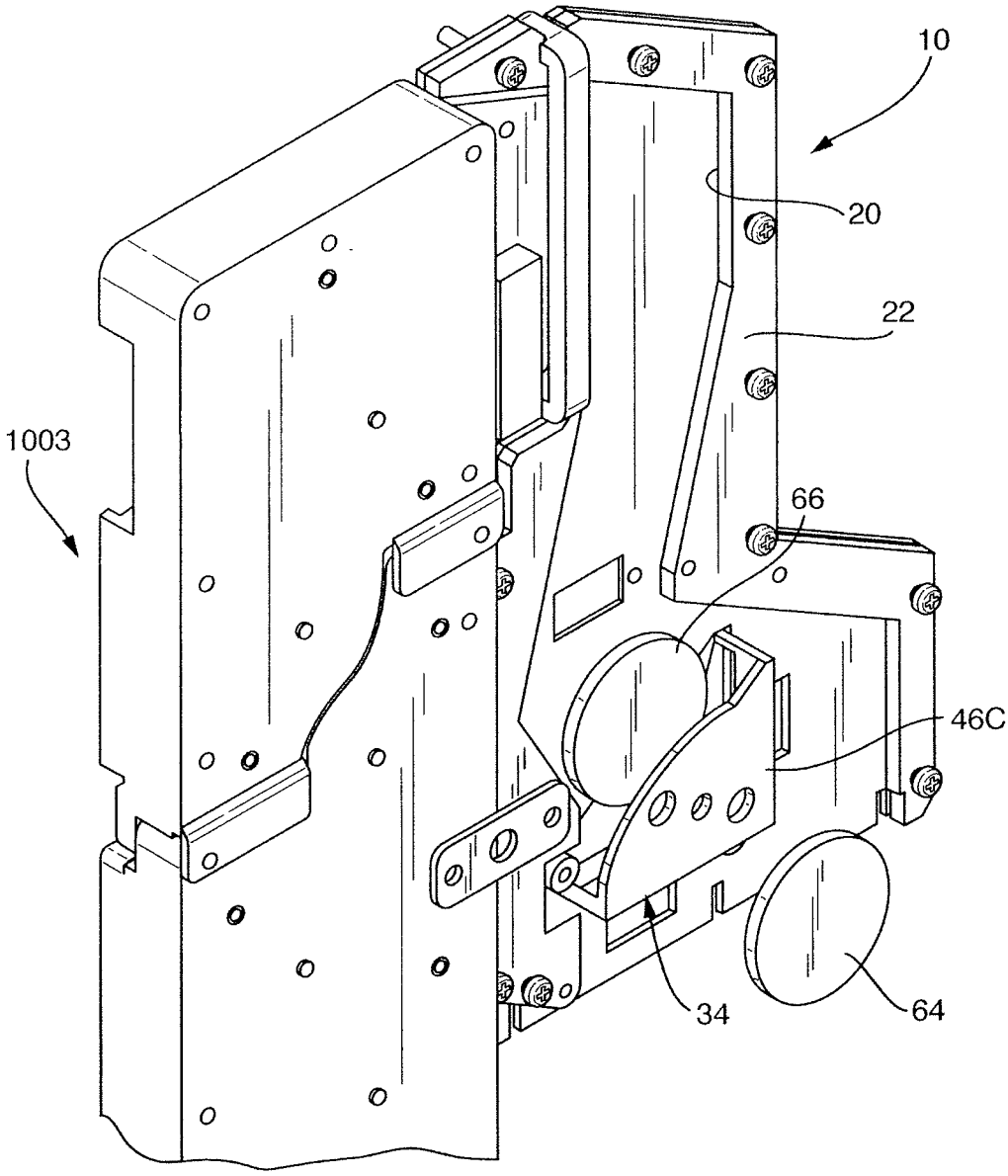

FIGS. 8C-8E illustrate the operation of the disk sorting device when a disk is to be diverted to the dispense outlet 38. In this case, the solenoid 30 is activated to move the actuator 32 against the spring bias which causes the diverting member 34 to be moved so as to bring the web 50 into alignment with the path 20.

As can be seen in FIG. 8D, a coin 64 arriving at the diverting member 34 passes into the slot 48B and engages the diverting surface 52. This causes the coin 64 to roll to the right (as seen in FIG. 8D) and to then drop down into the outlet 38. This can be seen again in FIG. 8E which also shows the arrival of the next coin 66 which also has to be diverted into the outlet 38.

Associated with each outlet 36, 38 is a respective coin sensor 70, 72 which detects the passage of coins into the respective outlets and thus can determine the presence of a jam if that should occur.

The coin entry sensor 26 is used to time operation of the solenoid 30 if required although depending upon the length of the path 20, the sensor 26 could be omitted and timing controlled from detection of coins by the coil 24. Indeed, in some embodiments, the sensors 70, 72 could also be omitted.

The outlet 38 is connected to a dispense opening or alternatively could be connected to an escrow store which itself then dispenses coins either to a dispense outlet or back to the hopper 900 via ducts (not shown).

It is also envisaged that more than two outlets could be provided together with a suitable diverting device.

Figure 9:
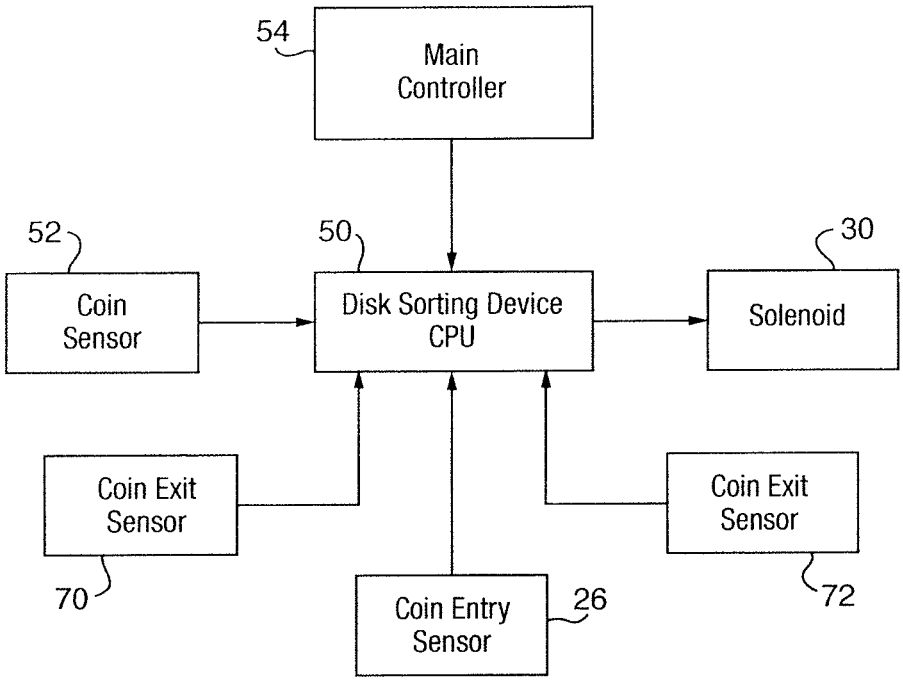

FIG. 9 is a block diagram illustrating the control components of the device shown in FIGS. 1 to 8. As can be seen, each of the coin entry sensors 26, coin exit sensors 70, 72 and solenoid 30 are connected to a disk sorting device CPU 50 which is also connected to the coin sensor 52 of which the coil 24 forms a part. The CPU 50 responds to control signals from the main controller 54 of the overall assembly so that the correct combination of coins is dispensed from the outlet 38.

The assembly can be operated in a variety of ways. In the preferred approach, the main controller 54 specifies which coins to use to make up the correct total value which is to be dispensed. Typically, the main controller 54 will monitor the quantity of each coin type held in the hopper 900 and can therefore determine which combination of coin types are available although this is not essential, particularly if the outlet 38 feeds to an escrow store. In any event, in a typical case, the main controller 54 will indicate to the CPU 50 that say two coins of a first type and three coins of a second type should be dispensed. (In this case "type" means "diameter" although many other means may be used to determine the value of a coin as mentioned above.) The disk transferring device 1003 is then activated and the coins are fed to the disk ejection opening 1104 and into the disk sorting device 10. The coin sensor 52 detects the coin type, typically by determining its diameter and hence its value, and this information is fed to the CPU 50. If the coin is to form part of the dispense then the CPU 50 will monitor for the arrival of the coin at the coin entry sensor 26 and either immediately or after a predetermined time interval, will activate the solenoid 30 to insert the diverter gate 34 into the guide path 20 so that the coin is diverted into the outlet 36. The passage of the coin into the outlet 36 is detected by the coin exit sensor 70 and providing that passage is confirmed, the solenoid 30 will then be deactivated and the diverter gate 34 will return under spring action to its retracted position.

If the coin sensor 52 identifies a coin which is not to be dispensed, for example it is of a type not required or sufficient coins of that type have been dispensed, then the CPU 50 will not activate the solenoid 30 and the coin will fall under gravity through the guide path 20 to the outlet 38 and back to the hopper 900.

In an alternative mode of operation, the main controller 54 will simply indicate the value which is to be dispensed and the appropriate combination of coins will be determined by the CPU 50. For example, if a value of £1 is to be dispensed, the CPU 50 will decide as each coin is identified by the coin sensor 52 how much value remains to be dispensed and will therefore vary the coins which form that dispense combination depending upon the coins that have been dispensed to date. This may, however, mean a less efficient operation due to the random nature in which coins are dispensed from the hopper.

What is claimed is:

1. A disk sorting device comprising:

a disk guide path configured to guide disks from a disk reception opening toward a disk ejection opening;

a housing defining a disk transport path for conveying disks from the disk ejection opening;

a disk identifying device located adjacent the disk transport path for identifying the type of disk passing along the transport path;

a disk diverting mechanism in the disk transport path downstream of the disk identifying device and operable to divert disks in accordance with the type of the disk determined by the disk identifying device into a selected one of at least a return path in which a disk returns to a source and a dispense path in which a disk is directed towards a dispense outlet;

a plurality of rotary disks extending along a direction of the disk guide path in a zigzag manner and configured to respectively rotate about a plurality of rotational axes; and a plurality of disk pushers respectively extending from the plurality of rotary disks and protruding into the disk guide path, the plurality of disk pushers configured to engage and push the disks by respectively rotating about the plurality of rotational axes lines, wherein:

the disk transport path is vertically configured such that disks pass along the path and the diverting mechanism under gravity, the disk diverting mechanism includes a single disk diverting surface movable orthogonally with respect to the disk transport path between a first position in which a disk passes to the return path, and a second position in which a disk passes to the dispense path, in one of the first and second positions, the surface is retracted away from the disk transport path so that a disk can fall undeflected past the disk diverting surface, and in the other of the first and second positions, the surface is inserted into the disk transport path.

2. A device according to claim 1, wherein the disk diverting surface is biased towards the retracted position.

3. A device according to claim 1, wherein when the disk diverting surface is in the first position, the surface is retracted away from the disk transport path, and when the disk diverting surface is in the second position, the surface is inserted into the disk transport path.

4. A device according to claim 1, wherein the disk diverting mechanism includes a solenoid to move the disk diverting surface.

5. A device according to claim 1, wherein the disk identifying device is configured to identify one or more of diameter, thickness, weight and surface appearance of the disks.

6. A device according to claim 1, wherein the disk guide path has first and second guide surfaces that guide a peripheral surface of each of the disks and third and fourth guide surfaces that guide a front surface and a back surface of a disk, the disk guide path extending from the disk reception opening toward the disk ejection opening.

7. A device according to claim 1, wherein the disk transport path is arranged to maintain substantially the same orientation of the disks as they have in the disk guide path.

8. A device according to claim 7, wherein the disk transport path and the disk guide path are arranged to maintain the faces of the disks vertically oriented.

9. A device according to claim 1, wherein the disk guide path and the disk transport path both extend generally vertically.

10. A device according to claim 1, wherein the disk guide path is detachable as a unit from the housing.

11. A device according to claim 1, further comprising a hopper for holding disks to be supplied to the disk reception opening, wherein the return path leads back into the hopper.

12. A device according to claim 1, wherein each disk pusher of the plurality of disk pushers comprise a pair of disk pushers arranged on straight lines passing through a rotational axis of the plurality of rotational axes.

13. A device according to claim 1, wherein each disk pusher of the plurality of disk pushers have a columnar outer shape.

14. A method of handling disks, the method comprising:

placing a plurality of disks of different types in a hopper;

supplying disks from the hopper to the disk reception opening of a disk transferring device;

operating the disk transferring device having a plurality of rotary disks arranged in a zigzag manner, to feed the disks one by one into a disk transport path of a disk sorting device by:

rotating the plurality of rotary disks about a plurality of rotational axes; and rotating a plurality of disk pushers respectively extending from the plurality of rotary disks and protruding into a disk guide path, such that the plurality of disk pushers engage and push the disks toward the disk transport path, by respectively rotating about the plurality of rotational axes lines;

identifying the type of disk passing through the disk transport path using a disk identifying device;

and operating a disk diverting device so as to feed a required combination of disks to a dispense path and to feed other disks to a return path.

15. A method according to claim 14, wherein the required combination of disks corresponds to a predetermined combination of disk types.

16. A method according to claim 14, wherein the different types of disks correspond to different monetary values, the required combination being defined by the total monetary value.

17. A method according to claim 14, wherein the disks comprise tokens of value such as coins.

* * * * *